US012709505B2

(12) United States Patent
Nguyen

(10) Patent No.: US 12,709,505 B2
(45) Date of Patent: Aug. 18, 2026

(54) SHEET CONVEYANCE DEVICE WITH CONVEYANCE ROLLER PAIR CAPABLE OF CONVEYING SHEET

(71) Applicant: KYOCERA Document Solutions Inc., Osaka (JP)

(72) Inventor: Trung Thanh Nguyen, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 60 days.

(21) Appl. No.: 18/810,304

(22) Filed: Aug. 20, 2024

(65) Prior Publication Data

US 2025/0066148 A1 Feb. 27, 2025

(30) Foreign Application Priority Data

Aug. 23, 2023 (JP) ..... 2023-135615

(51) Int. Cl.
*B65H 5/06* (2006.01)

(52) U.S. Cl.
CPC ..... *B65H 5/062* (2013.01); *B65H 2402/441* (2013.01); *B65H 2404/144* (2013.01); *B65H 2601/11* (2013.01)

(58) Field of Classification Search
CPC ..... B65H 2402/30; B65H 2404/1431; B65H 2404/17
See application file for complete search history.

(56) References Cited

U.S. PATENT DOCUMENTS 7,669,849 B2 * 3/2010 Liu ..... B65H 5/36 271/272
8,807,562 B2 * 8/2014 Yamaguchi ..... B41J 13/025 271/274
9,796,545 B2 * 10/2017 Morizono ..... B65H 5/38

FOREIGN PATENT DOCUMENTS

JP 2021059399 A 4/2021

* cited by examiner

*Primary Examiner* — Howard J Sanders
(74) *Attorney, Agent, or Firm* — IP Business Solutions, LLC.

(57) ABSTRACT

A sheet conveyance device includes a conveyance roller pair and a support portion that supports a driven roller of the conveyance roller pair. The driven roller includes a rotary shaft and a roller body supported rotatably by the rotary shaft. The support portion includes: a groove that is formed along a crosswise direction crossing an axial direction of the rotary shaft and receives the rotary shaft along the crosswise direction; a hook which is provided to project inwardly with respect to the groove and against which the rotary shaft is pressed; a biasing member that biases the rotary shaft toward the hook; and an elastically deformable lever disposed between the biasing member and the rotary shaft.

5 Claims, 6 Drawing Sheets

SHEET CONVEYANCE DEVICE WITH CONVEYANCE ROLLER PAIR CAPABLE OF CONVEYING SHEET

INCORPORATION BY REFERENCE

This application claims priority to Japanese Patent Application No. 2023-135615 filed on Aug. 23, 2023, the entire contents of which are incorporated by reference herein.

BACKGROUND

The present disclosure relates to sheet conveyance devices that convey sheets, such as original documents.

A sheet conveyance device, such as an original document conveyance device, feeds forward original document sheets placed on a sheet feed tray, sheet by sheet, and conveys them to an image reader in an image reading device. The original document conveyance device includes one or more conveyance roller pairs disposed at predetermined locations in a conveyance path.

The conveyance roller pair includes: a drive roller driven into rotation by a motor or the like; and a driven roller that follows the periphery of the rotating drive roller to rotate. The driven roller includes a rotary shaft and a roller body supported rotatably by the rotary shaft and the rotary shaft is supported by a support portion. The support portion includes: a groove formed therein along a direction crossing an axial direction of the rotary shaft; and a hook projecting inwardly with respect to the groove. The rotary shaft is supported by the support portion by inserting the rotary shaft into the groove and pressing the rotary shaft against the hook with a biasing member, such as a coiled spring.

SUMMARY

A technique improved over the aforementioned technique is proposed as one aspect of the present disclosure.

A sheet conveyance device according to an aspect of the present disclosure includes a conveyance roller pair and a support portion. The conveyance roller pair includes: a drive roller capable of being driven into rotation; and a driven roller that follows a periphery of the rotating drive roller to rotate. The support portion supports the driven roller. The driven roller includes a rotary shaft and a roller body. The roller body is supported rotatably by the rotary shaft. The support portion includes a groove, a hook, a biasing member, and a lever. The groove is formed along a crosswise direction crossing an axial direction of the rotary shaft and receives the rotary shaft along the crosswise direction. The hook is provided to project inwardly with respect to the groove and allows the rotary shaft to be pressed against the hook. The biasing member biases the rotary shaft toward the hook. The lever is disposed between the biasing member and the rotary shaft and elastically deformable.

DETAILED DESCRIPTION

Hereinafter, a description will be given of a sheet conveyance device according to an embodiment as one aspect of the present disclosure with reference to the drawings.

Figure 1:
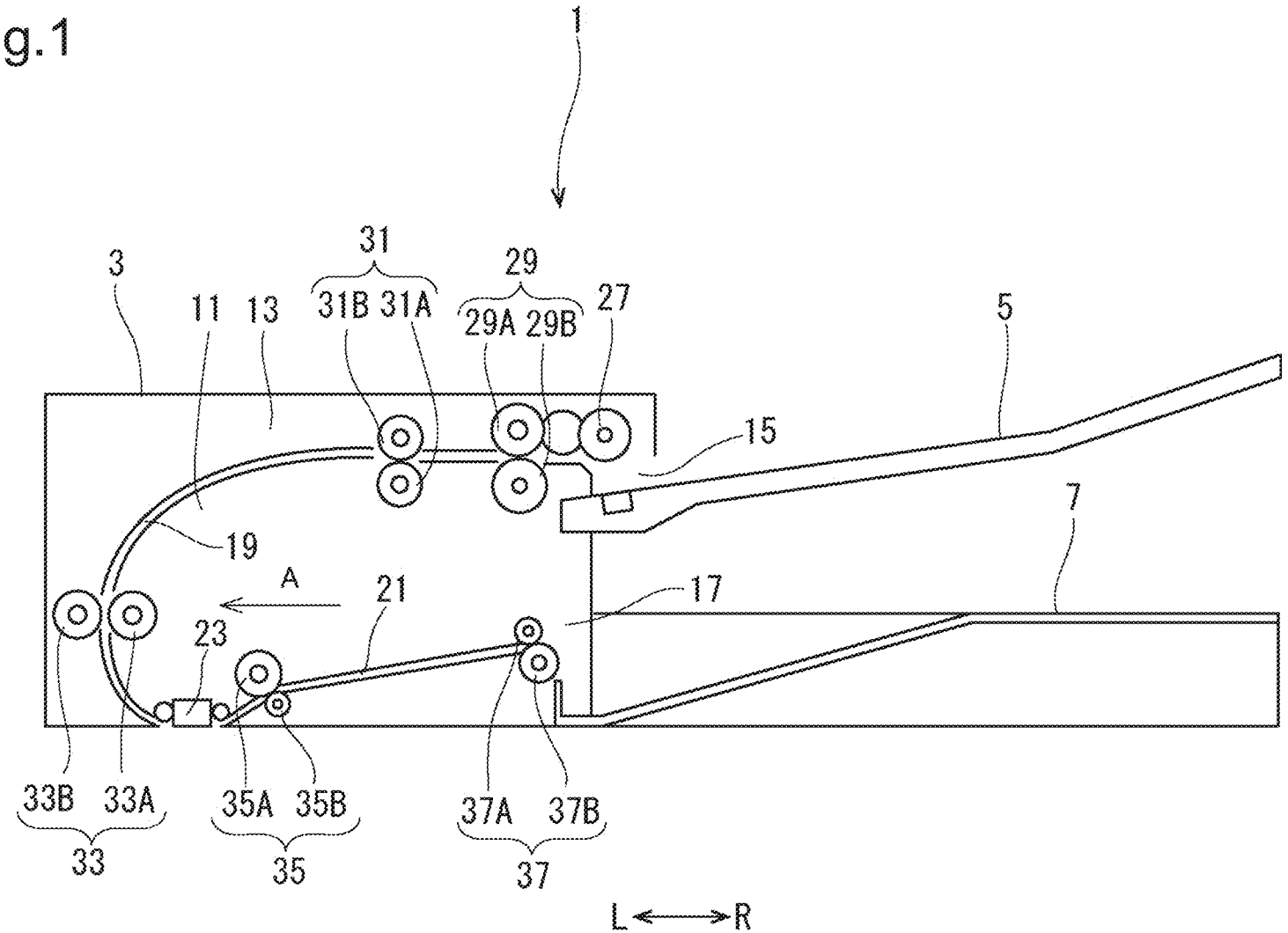
FIG. 1 is a cross-sectional view showing a sheet conveyance device according to one embodiment of the present disclosure.

First, referring to FIG. 1, the overall structure of a sheet conveyance device 1 will be described. FIG. 1 is a cross-sectional view showing the sheet conveyance device 1. The symbols Fr, Rr, L, and R shown in figures represent front, rear, left, and right sides, respectively, of the sheet conveyance device 1.

The sheet conveyance device 1 includes: a conveyance unit 3 in which an original document (a sheet) is to be conveyed; a sheet feed tray 5 on which the original document to be conveyed in the conveyance unit 3 is to be placed; and a sheet ejection tray 7 on which the original document having been conveyed in the conveyance unit 3 is to be loaded.

First, the conveyance unit 3 will be described. The conveyance unit 3 is composed of an inner guide portion 11 and an outer cover 13. The outer cover 13 is disposed to cover the top surface and left side surface of the inner guide portion 11 and supported pivotally at front and rear left bottom corners of the inner guide portion 11.

A sheet feed opening 15 and a sheet ejection opening 17 are formed in a right-side surface of the conveyance unit 3 in FIG. 1. The sheet feed opening 15 is formed between the inner guide portion 11 and the outer cover 13. The sheet ejection opening 17 is formed below the sheet feed opening 15 in a right-side surface of the inner guide portion 11 in FIG. 1.

In the conveyance unit 3, a first conveyance path 19 and a second conveyance path 21 are formed in both of which an original document is to be conveyed. The first conveyance path 19 is formed by and between an inside surface of the outer cover 13 and an outside surface of the inner guide portion 11 and extends from the sheet feed opening 15 to an image reading position 23. The first conveyance path 19 extends substantially horizontally and leftward from the sheet feed opening 15 and is then curved down toward the image reading position 23. The second conveyance path 21 is provided in the interior of the inner guide portion 11 and extends obliquely upward from the image reading position 23 to the sheet ejection opening 17.

The first conveyance path 19 is provided with, in order from upstream to downstream in a direction of conveyance of a sheet, a pick-up roller 27, a separation roller pair 29, a first conveyance roller pair 31, and a second conveyance roller pair 33. The separation roller pair 29 is composed of a sheet feed roller 29A and a retard roller 29B. The first conveyance roller pair 31 is disposed in a horizontal portion of the first conveyance path 19 and composed of: a drive roller 31A capable of being driven by a motor; and a driven roller 31B that follows the periphery of the rotating drive roller 31A to rotate. The second conveyance roller pair 33 is disposed in a curved portion of the first conveyance path 19 and composed of: a drive roller 33A capable of being driven by a motor; and a driven roller 33B that follows the periphery of the rotating drive roller 33A to rotate. The pick-up roller 27, the sheet feed roller 29A, and the driven rollers 31B, 33B of the first and second conveyance roller pairs 31, 33 are supported by the inside surface of the outer cover 13. The retard roller 29B and the drive rollers 31A, 33A of the first and second conveyance rollers 31, 33 are supported by the outside surface of the inner guide portion 11.

When the outer cover 13 is closed, the first conveyance path 19 is formed, the sheet feed roller 29A abuts the retard roller 29B, and a separation nip is thus formed between both the rollers 29A, 29B. At this time, the driven rollers 31B and 33B of the first and second conveyance roller pairs 31 and 33 abut the drive rollers 31A and 33A, respectively, thereof. On the other hand, when the outer cover 13 is opened, the first conveyance path 19 is open. Thus, sheet jam clearance and other maintenance woks can be performed.

The second conveyance path 21 is provided with, in order from upstream to downstream in the direction of sheet conveyance, a third conveyance roller pair 35 and an ejection roller pair 37. The third conveyance roller pair 35 and the ejection roller pair 37 include: drive rollers 35A and 37A, respectively, each capable of being driven into rotation by a motor; and driven rollers 35B and 37B, respectively, that follow the peripheries of the rotating drive rollers 35A and 37A, respectively, to rotate.

Next, the sheet feed tray 5 will be described. The sheet feed tray 5 is a board-shaped member having a size with which an original document of a maximum conveyable size can be placed thereon. The top surface of the sheet feed tray 5 is a document placement surface on which an original document is to be placed. The sheet feed tray 5 is provided with a side cursor (not shown) that is slidable in a widthwise direction of an original document (in a direction orthogonal the direction of sheet conveyance) to adjust an original document placed on the document placement surface to the widthwise center of the document placement surface. The sheet feed tray 5 is supported, in a manner inclined down toward the sheet feed opening 15, at a portion of the inner guide portion 11 of the conveyance unit 3 below the sheet feed opening 15.

Next, the sheet ejection tray 7 will be described. The sheet ejection tray 7 is formed below the sheet feed tray 5 to extend from below the sheet ejection opening 17 downstream in the direction of sheet conveyance while inclining upward.

Figure 2:
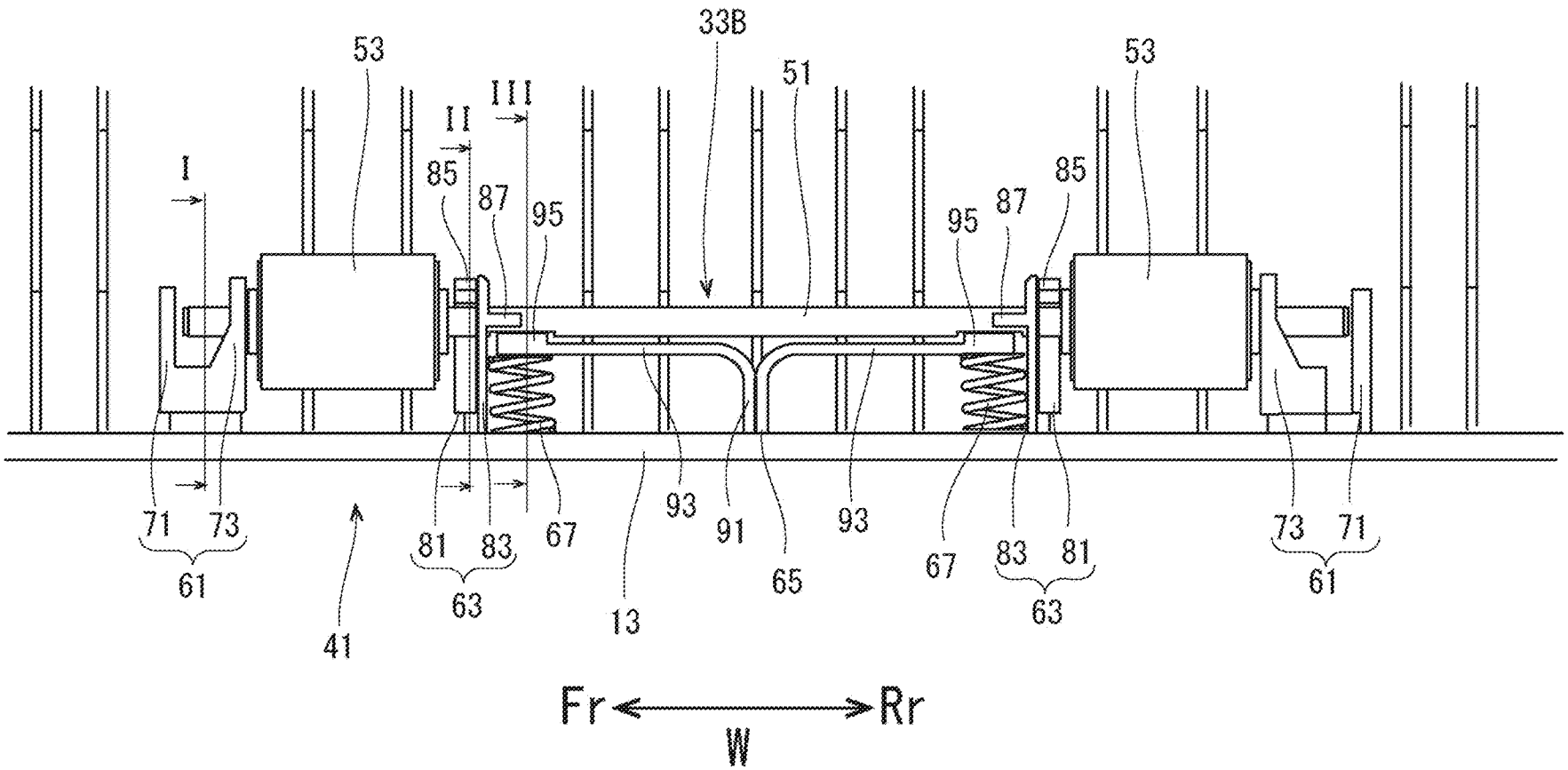
FIG. 2 is a side view showing how, in the sheet conveyance device according to the one embodiment of the present disclosure, a driven roller supported by a support portion is viewed from the direction of the arrow A in FIG. 1.
Figure 3:
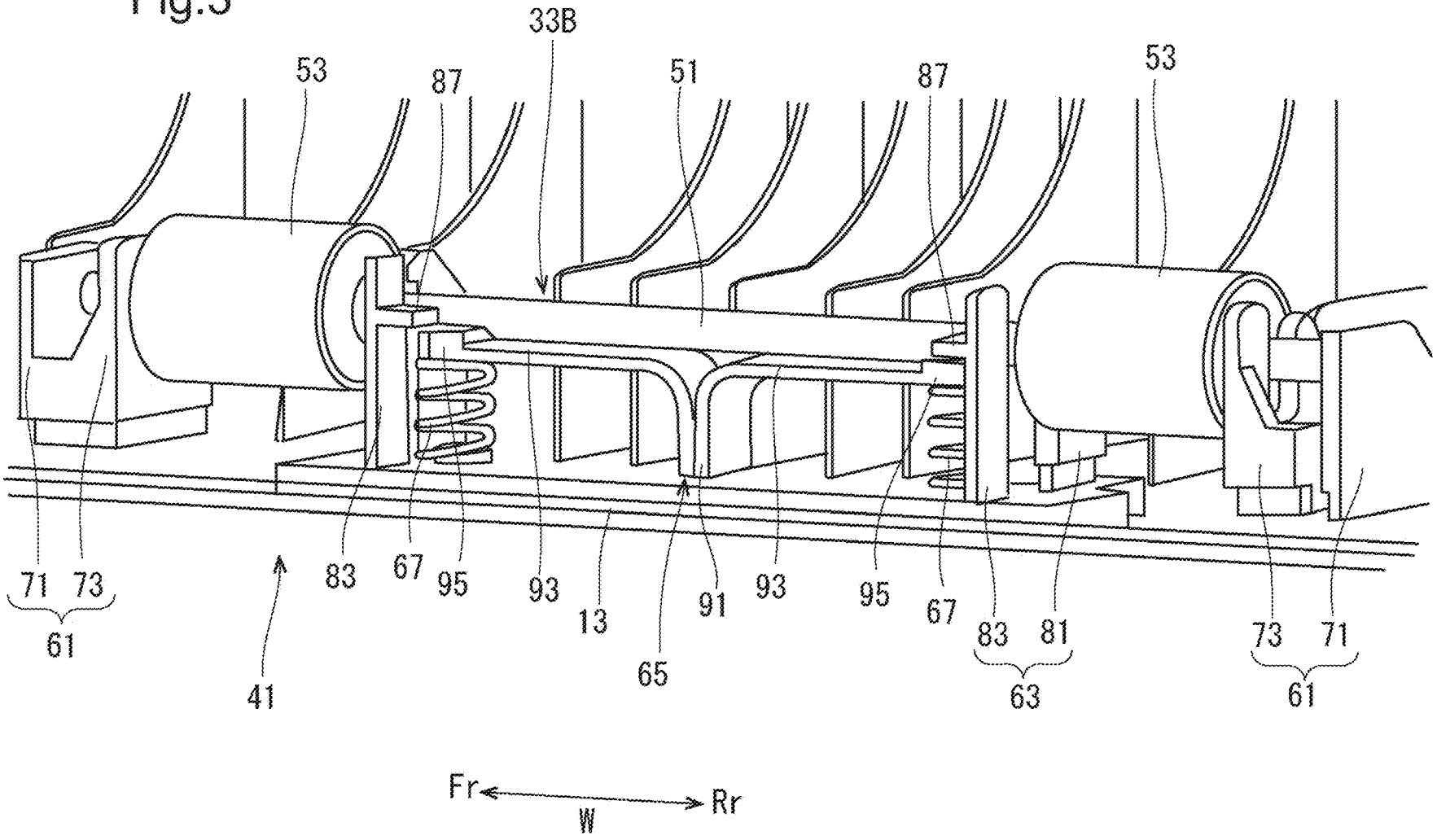
FIG. 3 is a perspective view showing how, in the sheet conveyance device according to the one embodiment of the present disclosure, the driven roller supported by the support portion is viewed from the direction of the arrow A in FIG. 1.
Figure 4A:
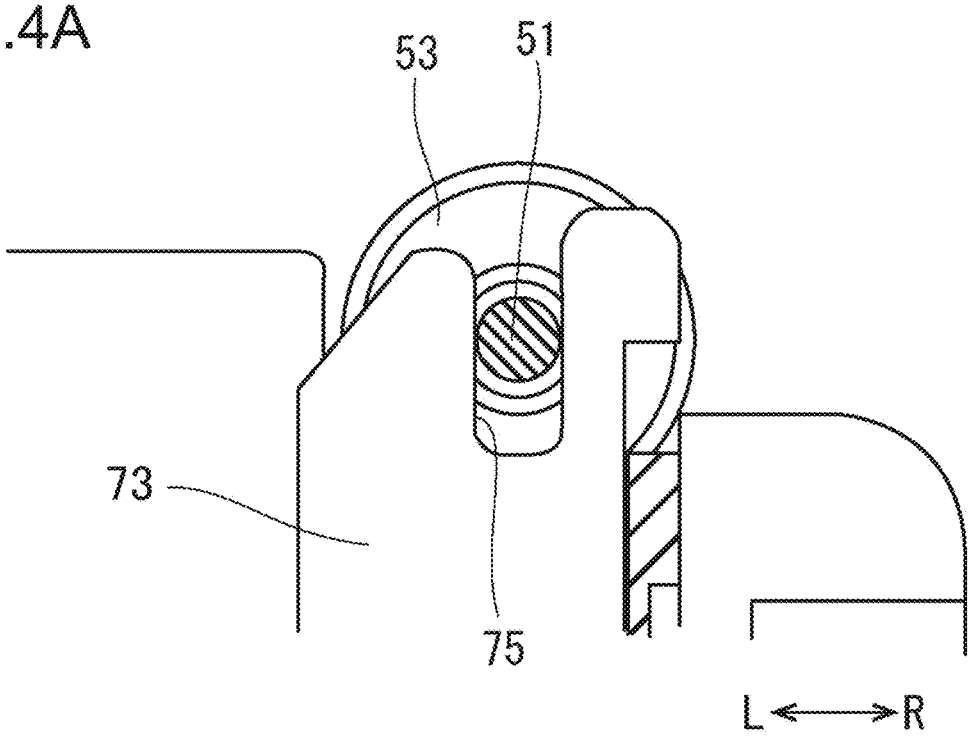
FIG. 4A is a cross-sectional view taken along the line I-I in FIG. 2.
Figure 4B:
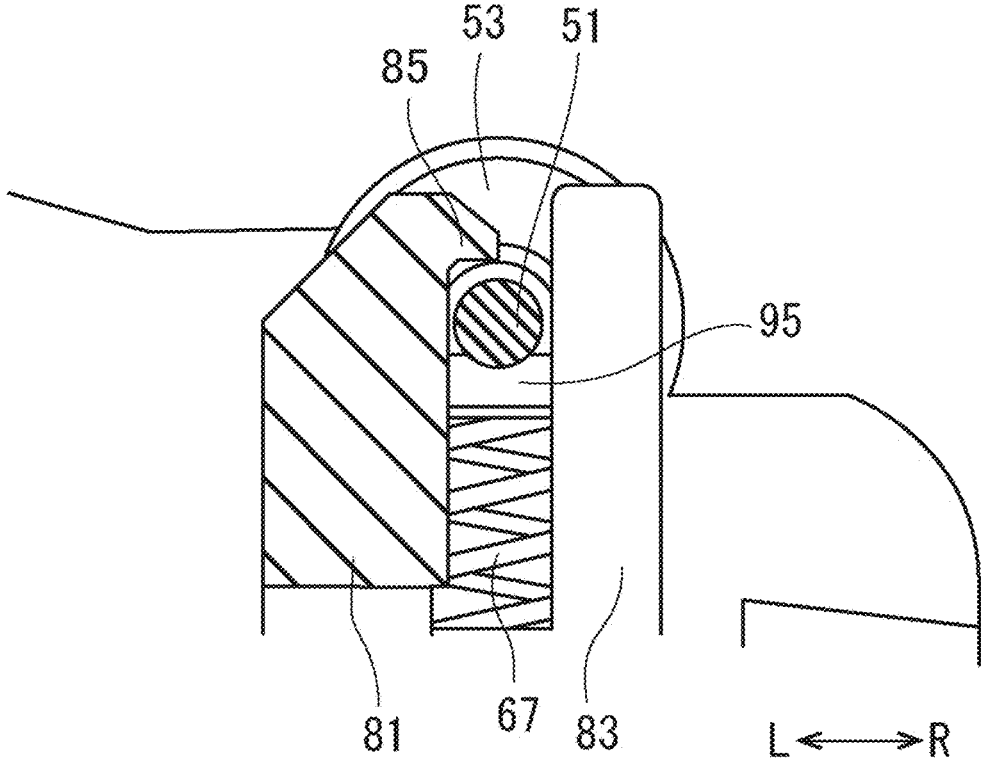
FIG. 4B is a cross-sectional view taken along the line II-II in FIG. 2.
Figure 4C:
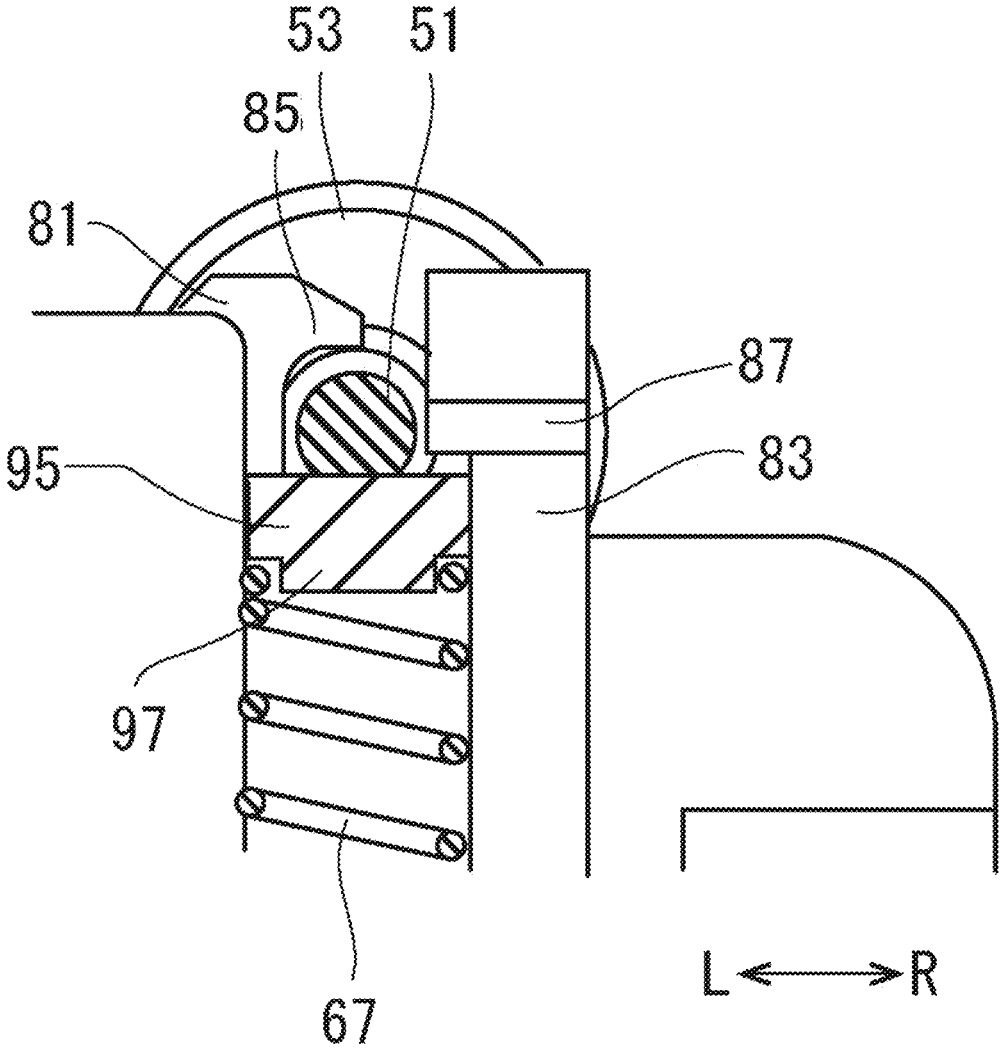
FIG. 4C is a cross-sectional view taken along the line III-III in FIG. 2.
Figure 5:
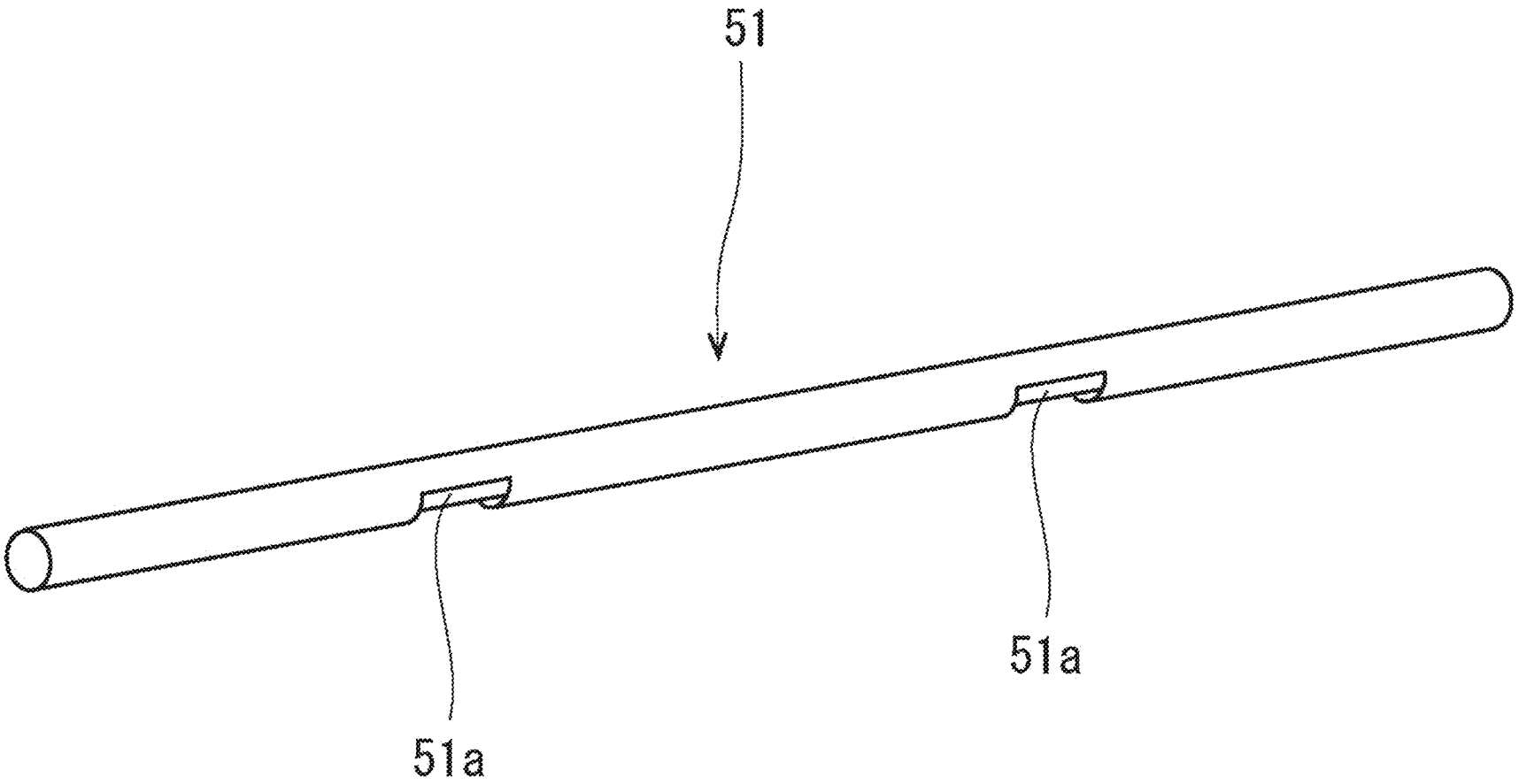
FIG. 5 is a cross-sectional view showing a rotary shaft of the driven roller in the sheet conveyance device according to the one embodiment of the present disclosure.

Next, the driven roller 33B of the second conveyance roller pair 33 will be described with reference to FIGS. 2, 3, 4A to 4C, and 5. FIG. 2 is a side view showing how in the sheet conveyance device 1 the driven roller 33B supported by a support portion is viewed from the direction of the arrow A in FIG. 1. FIG. 3 is a perspective view showing how in the sheet conveyance device 1 the driven roller 33B supported by the support portion is viewed from the direction of the arrow A in FIG. 1. FIGS. 4A, 4B, and 4C are cross-sectional views taken along the line I-I, the line II-II, and the line III-III, respectively, in FIG. 2. FIG. 5 is a perspective view showing a rotary shaft 51.

As described previously, the second conveyance roller pair 33 is composed of the drive roller 33A and the driven roller 33B. The driven roller 33B is supported by a support portion 41 provided on the inside surface of the outer cover 13.

First, the driven roller 33B will be described. As shown in FIGS. 2 and 3, the driven roller 33B includes a rotary shaft 51 and two roller bodies 53 supported rotatably by the rotary shaft 51. As shown in FIG. 5, the rotary shaft 51 has two flat surfaces 51*a* formed a predetermined distance apart from each other in the axial direction and each extending in parallel with the axial direction. The two flat surfaces 51*a* are formed at the same position in a circumferential direction of the rotary shaft 51.

As shown in FIGS. 2 and 3, the two roller bodies 53 are disposed lateral to the two flat surfaces 51*a* in the axial direction and retained on the rotary shaft 51 by a stop ring or the like against falling off from the rotary shaft 51.

Next, the support portion 41 will be described. As shown in FIGS. 2 and 3, the support portion 41 includes: two outside supports 61; two inside supports 63; a bifurcated lever member 65 disposed between the two inside supports 63; and two coiled springs 67 biasing the lever member 65.

First, the outside supports 61 will be described. The outside supports 61 are disposed on both end portions of the inside surface of the outer cover 13 in a widthwise direction thereof and support respective portions of the rotary shaft 51 of the driven roller 33B located lateral to the two roller bodies 53. Each of the outside supports 61 includes a support piece 73 and a restriction piece 71 disposed a predetermined distance apart from each other in the widthwise direction of the outer cover 13. The support piece 73 and the restriction piece 71 are formed along the direction of sheet conveyance and perpendicularly to the inside surface of the outer cover 13. The support piece 73 is disposed more inwardly in the widthwise direction than the restriction piece 71 and the restriction piece 71 is disposed more laterally in the widthwise direction than the support piece 73. As shown in FIG. 4A, the support piece 73 has a groove 75 formed from an upper end thereof along the direction perpendicular to the inside surface of the outer cover 13 shown in FIGS. 2 and 3 (the direction crossing the widthwise direction, i.e., the top-to-bottom direction thereof). The width of the groove 75 is slightly larger than the diameter of the rotary shaft 51 of the driven roller 33B. The groove 75 has a predetermined depth.

Next, the inside supports 63 will be described. The inside supports 63 are disposed more inwardly than the outside supports 61 in the widthwise direction of the outer cover 13 and support respective portions of the rotary shaft 51 of the driven roller 33B located inwardly of the two roller bodies 53. Each of the inside supports 63 includes an outer guide piece 81 and an inner guide piece 83 disposed respective distances apart from each other in the widthwise direction and in the direction of sheet conveyance. The outer guide piece 81 and the inner guide piece 83 are arranged along the direction of sheet conveyance and formed perpendicularly to the inside surface of the outer cover 13 shown in FIGS. 2 and 3. The outer guide piece 81 is disposed more laterally than the inner guide piece 83 in the widthwise direction and the inner guide piece 83 is disposed more inwardly than the outer guide piece 81 in the widthwise direction.

Furthermore, as shown in FIG. 4B, the outer guide piece 81 and the inner guide piece 83 are disposed a distance apart from each other in the direction of sheet conveyance, the distance corresponding to the width of the groove 75 formed in the support piece 73 of the outside support 61. Specifically, as viewed from the widthwise direction, respective opposed side edges of the outer guide piece 81 and the inner guide piece 83 are coincident with both side edges of the groove 75 in the direction of sheet conveyance of the sheet.

The height of the gap between the opposed side edges of the outer and inner guide pieces 81, 83 is larger than the depth of the groove 75.

A hook 85 is formed at a distal end of the outer guide piece 81. The hook 85 protrudes into the gap as viewed from the widthwise direction. Furthermore, as shown in FIGS. 2 and 3, rectangular projections 87 projecting inwardly in the widthwise direction are formed on the respective opposed surfaces of the inner guide pieces 83 facing inwardly in the widthwise direction. The projections 87 are formed below the hooks 85. The inside supports 63 are made of resin.

Next, the lever member 65 will be described with reference to FIGS. 2 and 3. The lever member 65 is disposed between the two inside supports 83. The lever member 65 includes: a basal portion 91 fixed to the inside surface of the outer cover 13; and two strip-shaped branched portions 93 branched from the basal portion 91 in mutually opposite directions toward the two inside supports 63. Respective distal end portions 95 of the two branched portions 93 are formed in tabular shape. As also shown in FIG. 4C, each of the distal end portions 95 of the two branched portions 93 is located in the gap between the outer and inner guide pieces 81 and 83 of the associated inside support 63 as viewed from the widthwise direction and below the projection 87 of the inner guide piece 83. The top surface of the distal end portion 95 is formed flatly, while the bottom surface of the distal end portion 95 is provided with a boss 97. The lever member 65 is made of resin.

Next, the coiled springs 67 will be described. As shown in FIGS. 2 and 3, each of the coiled springs 67 is disposed between the boss 97 formed at one or the other of the distal end portions 95 of both the branched portions 93 of the lever member 65 and another boss (not shown) formed on the inside surface of the outer cover 13 oppositely to the boss 97. The coiled springs 67 bias the respective associated distal end portions 95 of the branched portions 93 of the lever member 65 in the direction perpendicular to the inside surface of the outer cover 13.

A description will be given of the procedure for allowing the support portion 41 having the above structure to support the driven roller 33B. First, both end portions of the rotary shaft 51 (portions thereof lateral to both the roller bodies 53) in the widthwise direction are inserted into the grooves 75 in the support pieces 73 of the outside supports 61 from the openings of the grooves 75. In doing so, the orientation of the flat surfaces 51*a* (see FIG. 5) of the rotary shaft 51 does not matter. At this time, the portion of the rotary shaft 51 inward of both the roller bodies 53 is inserted into the gaps between the outer guide pieces 81 and the inner guide pieces 83 of the inside supports 63. When the rotary shaft 51 abuts the hooks 85 of the outer guide pieces 81 in the course of insertion into the gaps in the above manner, the rotary shaft 51 pushes down the hooks 85 and, thus, the outer guide pieces 81 elastically deform and bend away from the inner guide pieces 83. The support portion 41 is made of an elastically deformable material. When the hooks 85 are pushed by the rotary shaft 51 while the rotary shaft 51 is inserted into the grooves 75, the support portion 41 bends and deforms toward guiding the rotary shaft 51 into the groove 75. By this deformation, the rotary shaft 51 passes between the hooks 85 and the inner guide pieces 83.

The rotary shaft 51 having passed between the hooks 85 and the inner guide pieces 83 abuts the distal end portions 95 of the branched portions 93 of the lever member 65 and, concurrently, the hooks 85 are released from being pushed by the rotary shaft 51. Therefore, the hooks 85 elastically return to their original shape. In doing so, the distal end portions 95 of the branched portions 93 are biased by the coiled springs 67 and, therefore, the rotary shaft 51 is biased through the distal end portions 95 by the coiled springs 67 and thus engaged against the hooks 85.

In a state where the rotary shaft 51 is engaged against the hooks 85, as shown in FIG. 4A, it does not reach the bottoms of the grooves 75 in the support pieces 73 of the outside supports 61. In addition, the end surfaces of the rotary shaft 51 in the widthwise direction face the restriction pieces 71 of the outside supports 61. Thus, the movement of the rotary shaft 51 in the widthwise direction (the axial direction of the rotary shaft 51) is restricted.

After the rotary shaft 51 is supported by the support portion 41 in the above manner, the outer cover 13 is closed and the operation of conveying an original document is started. In doing so, the drive roller 33A is driven into rotation by the motor and the driven roller 33B follows the periphery of the rotating drive roller 33A to rotate. At this time, the rotary shaft 51 also rotates. However, when in course of rotation of the rotary shaft 51 the flat surfaces 51*a* of the rotary shaft 51 mesh with the flat surfaces of the distal end portions 95 of the branched portions 93 of the lever member 65, the rotation of the rotary shaft 51 is restricted. Thereafter, according to the conveyance of the original document, the roller bodies 53 rotate with respect to the rotary shaft 51.

As described previously, in the present disclosure, the rotary shaft 51 is biased through the resin-made lever member 65 toward engagement against the hooks 85. Therefore, any squeak noise due to contact between the rotary shaft 51 and the coiled springs 67 is not produced. Furthermore, simply by inserting the rotary shaft 51 into the grooves 75, the rotary shaft 51 can be biased from below toward the hooks 85 through the lever member 65 by the coiled springs 67. Therefore, with such a simple operation, the rotary shaft 51 can be engaged against the hooks 85.

Since the second conveyance roller pair 33 is disposed in the curved portion of the first conveyance path 19, a large load is applied from an original document to the rollers. Therefore, oscillation of the rotary shaft 51 is large, which might make it likely that squeak noises occur. However, in the present disclosure, squeak noises, particularly produced from the conveyance roller pair disposed in the curved portion of the conveyance path, can be reduced with a simple structure.

Since the rotation of the rotary shaft 51 is automatically stopped, the oscillation of the rotary shaft 51 can be reduced and the roller bodies 53 can be smoothly rotated.

Furthermore, since the movement of the branched portions 93 of the lever member 65 is limited by the projections 87 provided on the inner guide pieces 83 of the inside supports 63, damage to the lever member 65 in allowing the lever member 65 to support the driven roller 33B can be reduced.

Although the description in the above embodiment has been given of the second conveyance roller pair 33 provided in the curved portion of the conveyance path in the conveyance unit 3, the driven roller 31B of the first conveyance roller pair 31 provided in the horizontal portion of the conveyance path and a driven roller of a conveyance roller pair provided in a conveyance path in an image formation unit (not shown) may also be supported by support portions like the above-described support portion 41.

In the driven roller constituting part of the conveyance roller pair in the previously described general sheet conveyance device not according to the above embodiment, for the purpose of reducing squeak noises produced by contact between the coiled spring and the rotary shaft, the coiled spring is covered with a cap to keep the coiled spring from direct contact with the rotary shaft. However, in this case, the size of the cap is small, which presents a problem of difficulty in the work for supporting the driven roller on the support portion.

Unlike the general sheet conveyance device, in the above embodiment, the driven roller can be supported with a simple work and the production of squeak noises between the rotary shaft 51 of the driven roller 31B and the coiled springs 67 can be reduced.

While the present disclosure has been described in detail with reference to the embodiments thereof, it would be apparent to those skilled in the art that the various changes and modifications may be made therein within the scope defined by the appended claims.

What is claimed is:

1. A sheet conveyance device comprising:

a conveyance roller pair comprising a drive roller capable of being driven into rotation and a driven roller that follows a periphery of the rotating drive roller to rotate;

a support portion that supports the driven roller; and a cover member configured to be openable and closable with respect to an interior of the sheet conveyance device and provided with the support portion, the driven roller comprising a rotary shaft and a roller body supported rotatably by the rotary shaft, the support portion comprising:

a groove that is formed along a crosswise direction crossing an axial direction of the rotary shaft and receives the rotary shaft along the crosswise direction;

a hook which is provided to project inwardly with respect to the groove and against which the rotary shaft is pressed;

a biasing member that biases the rotary shaft toward the hook; and an elastically deformable lever including a base portion fixed to the cover member and a branched portion connected to an end of the base portion and extending toward the support portion, the branched portion having a distal end portion disposed between the biasing member and the rotary shaft, wherein the branched portion elastically deforms in accordance with a pressing force applied from the biasing member to the distal end portion, thereby causing the distal end portion to press the rotary shaft toward the hook.

2. The sheet conveyance device according to claim 1, wherein the support portion is made of an elastically deformable material, when the hook is pushed by the rotary shaft in course of insertion of the rotary shaft into the groove, the support portion bends and deforms toward guiding the rotary shaft into the groove, and when the hook is released from being pushed by the rotary shaft, the support portion returns to an original shape before being pushed by the rotary shaft and, in this state, the biasing member biases the rotary shaft toward the hook.

3. The sheet conveyance device according to claim 1, wherein the rotary shaft has a flat surface formed by cutting away a portion of an outer periphery of the rotary shaft along a direction parallel to the axial direction of the rotary shaft, the distal end portion has a flat distal end surface, and when the rotary shaft rotates until the flat surface of the rotary shaft meshes with the distal end surface of the distal end portion, rotation of the rotary shaft is restricted.

4. The sheet conveyance device according to claim 1, wherein the support portion comprises a projection that is provided on a side opposite to the biasing member across the distal end portion, and limits an elastic deformation movement of the branched portion.

5. The sheet conveyance device according to claim 4, wherein the biasing member is disposed between the distal end portion and the cover member and biases the distal end portion toward the projection.

* * * * *